US007360256B1

(12) United States Patent
Jiles et al.

(10) Patent No.: US 7,360,256 B1
(45) Date of Patent: Apr. 22, 2008

(54) FOOD CONTAINER AND BIB

(76) Inventors: Leroy Jiles, 16037 S. Evans Ave., South Holland, IL (US) 60473; Lavon Jiles, 1109 75th St. Apt. 9, Darien, IL (US) 60561

( * ) Notice: Subject to any disclaimer, the term of this patent is extended or adjusted under 35 U.S.C. 154(b) by 251 days.

(21) Appl. No.: 11/218,811

(22) Filed: Sep. 2, 2005

(51) Int. Cl.
*A41B 13/10* (2006.01)

(52) U.S. Cl. ..... 2/49.1; 2/48; 206/542

(58) Field of Classification Search ..... 2/48, 2/49.1–49.5, 51, 52, 46; 383/4, 902, 105; 224/270, 148.4, 575, 576, 577, 906, 600, 224/607; 206/216, 541, 542, 549, 581
See application file for complete search history.

(56) References Cited

U.S. PATENT DOCUMENTS 2,364,258 A * 12/1944 Wallace ..... 2/92
2,704,625 A * 3/1955 Huse ..... 224/576
2,831,624 A * 4/1958 Lever ..... 383/4
3,283,971 A * 11/1966 Jones ..... 224/183
4,860,381 A * 8/1989 Bartley ..... 2/49.3
4,941,756 A 7/1990 Price
4,946,094 A * 8/1990 Stang ..... 224/270
4,985,932 A * 1/1991 Bezdek ..... 2/49.2
5,056,159 A * 10/1991 Zemke, Jr. ..... 2/46
5,062,558 A * 11/1991 Stang ..... 224/270
5,328,265 A 7/1994 Clooney
5,530,968 A 7/1996 Crockett
5,642,674 A * 7/1997 Joye et al. ..... 108/43
5,701,605 A * 12/1997 Bowen ..... 2/49.1
5,842,631 A 12/1998 Berger
5,850,956 A * 12/1998 Hayward, Jr. ..... 224/270
5,964,534 A 10/1999 Welles
6,113,266 A 9/2000 Skidmore
6,243,869 B1 * 6/2001 Ekovich ..... 2/48
6,332,220 B1 * 12/2001 Mai ..... 2/51
7,043,764 B2 * 5/2006 Sky ..... 2/49.1
7,178,170 B2 * 2/2007 Thompson ..... 2/48
2002/0066133 A1 * 6/2002 Frye ..... 2/49.1
2006/0174390 A1 * 8/2006 Wakhloo et al. ..... 2/48

* cited by examiner

*Primary Examiner*—A. Vanatta
(74) *Attorney, Agent, or Firm*—Lloyd L. Zickert

(57) ABSTRACT

A food container and bib wherein the container may be in the form of a sack or box for receiving prepared foods and the bib will be in folded form and removably attached to the container to facilitate use of the bib during the consumption of the foods in the container to avoid soiling of clothing. The bib includes a hanger and is folded and compact, and unfoldable so that it may be easily and quickly hung from a user's neck.

17 Claims, 6 Drawing Sheets

FOOD CONTAINER AND BIB

This invention relates in general to a food container and bib for serving prepared foods to a person or patron, thereby providing the person or patron with a bib usable to prevent the soilage of clothing during consumption of food from the container, and more particularly to a food container and a folded bib wherein the bib is removably attached to the container, and when removed therefrom unfolded for use. The invention further relates to a folded bib that may be dispensed separately from a food container.

BACKGROUND OF THE INVENTION

Heretofore, it has been known to provide a bag for the storage and carrying of food with an attached napkin, as disclosed in U.S. Pat. No. 4,941,756, wherein the napkin is attached to the bag by a seam allowing separation of the napkin from the bag.

It has also been known to provide a combination bag and napkin, as disclosed in U.S. Pat. No. 5,328,265, wherein the bag is convertible to a napkin for use while eating. The bag maintains the bag configuration by use of pressure-sensitive non-drying adhesive which also serves to attach the napkin to a person's clothing.

It has been further known to provide a commuter's apron capable of containing food and drink spillage in an automobile, as disclosed in U.S. Pat. No. 5,530,968.

It has also been known to provide a container capable of holding foods and being in combination with a compartment mounted on the front panel of the container to hold condiments such as ketchup and facilitate the use of the ketchup when consuming the contents of the food in the container, as is disclosed in U.S. Pat. No. 5,842,631.

It has been further known to provide a bag of flexible material for packaging an edible food product and supporting the product for eating purposes, as disclosed in U.S. Pat. No. 5,964,534. Further, the bag is foldable outwardly about the package to provide a skirt covering the consumer's hand.

It has also been known to provide a disposable tray for use with an infant car seat wherein the tray is formed from a sack containing food stuff such as might be provided by a fast-food restaurant, as disclosed in U.S. Pat. No. 6,113,266. Additionally, the sack includes panels that may be separated from other panels along perforations to facilitate the wrapping of the panels around the crossbar of the car seat to hold the tray in place.

SUMMARY OF THE INVENTION

The container and bib of the present invention provides a convenient and inexpensive system for dispensing prepared foods like such foods served in a fast-food restaurant, while providing the person or patron purchasing the foods with a container for the foods with a bib attached to the container for easy removal and use by the patron during the consumption of the food from the container. Accordingly, the present invention is in general to a container and a bib wherein the container is initially in folded form for ease of storage and handling and which can be easily opened for the loading of prepared foods and the serving of the foods to a patron or person purchasing the food, while at the same time providing a bib removably attached to the container for use by the patron or person during consumption of the food from the container.

More specifically, the container may be in the form of a sack or bag, or in the form of a box, either of which would be initially in folded form to facilitate storage and handling and which would be openable for introduction of prepared foods. The bib would be removably attached to one panel of the sack or box so that the user can readily remove the bib for usage to prevent soilage of clothing when consuming the food from the container. It will be appreciated that the container may be made of any suitable material but would normally be made of a paper that is suitable for the handling of food products or a paperboard when the container is in box form. Either container would normally be disposed of after use.

Similarly, it will be appreciated that the bib may be of any suitable material and would be removably attached to the container in folded form. Preferably, the bib would be made of a suitable absorbent paper that would be inexpensive to manufacture. However, it should be appreciated that the bib could be made of a suitable absorbent fabric or other synthetic material if desired. The bib would normally be disposed of after use.

When making the container, it will be appreciated that it would comprise one or more flat walls made out of a flexible material and closed at least at one end. While the container and bib of the present invention will be particularly useful in the handling of prepared foods in a fast-food restaurant, it could otherwise be used in any type of restaurant where there could be a need for packaging prepared foods to be consumed by the purchaser and where it would be particularly advantageous for the purchaser to have a bib that could easily be used to protect clothing during consumption of the food. It will be appreciated that additional folded bibs may also be provided by the server or otherwise be available for a customer.

The bib would be in folded position when attached to a container such that it would not be unfolded or unfoldable until it is removed from the container. The bib would be attached to the container in any suitable manner such as by a low-tack, repositionable, pressure-sensitive adhesive. Such an adhesive would not leave a residue or cause tearing of the bag or bib during removal of the bib from the bag.

Further, it would be appreciated that the bib of the invention when unfolded would include a hanger to facilitate the hanging of the bib from the neck of a person. One form of a hanger would be a hook-shaped member, while another could be a horseshoe-shaped member. Still another form could be a strand or filament permanently connected at one end to one side of the bib, and detachably connected at the other end to the other side of the bib.

Inasmuch as some patrons may want more than a single bib, additional folded bibs may also be provided. For example, where a customer would purchase a large container, such as a tub container of chicken for a family, the customer would want a bib for each person eating the chicken. Thus, one or more additional bibs could be sold to the customer. These bibs could be supplied one at a time or in a packet of a plurality of bibs.

It is therefore an object of the present invention to provide a new and improved container and bib assembly that would enhance the serving of prepared foods particularly in a: fast-food restaurant while also providing to the purchaser a bib that is removably attached to the container.

A further object of the present invention is to provide a new and improved container and bib assembly for the serving of prepared foods to a customer that would provide the customer with a folded bib openable for use during the consumption of the prepared food loaded into the container and including a hanger for supporting the bib from the neck of the user.

Another object of the present invention is to provide a new and improved container and bib for the handling of prepared foods and the preservation of a person's clothing during consumption of the foods where it would be economical to manufacture and easy to use and particularly easy for the mounting of the bib on a person during the consumption of the foods.

A still further object of the invention is to provide a new and improved folded bib that may be unfolded to a form for mounting the bib on the user to protect against soiling clothing.

Another object of the invention is to provide an inexpensive folded bib as a single bib or in a packet of bibs for a user.

Other objects, features and advantages of the invention will be apparent from the following detailed disclosure, taken in conjunction with the accompanying sheets of drawings, wherein like reference numerals refer to like parts.

DESCRIPTION OF THE INVENTION

The present invention in general relates to a combination of a container and a folded bib removably attached to the container, and additionally to a folded bib that may be provided to a person in addition to providing the person with a food container and folded bib unit.

Figure 1:
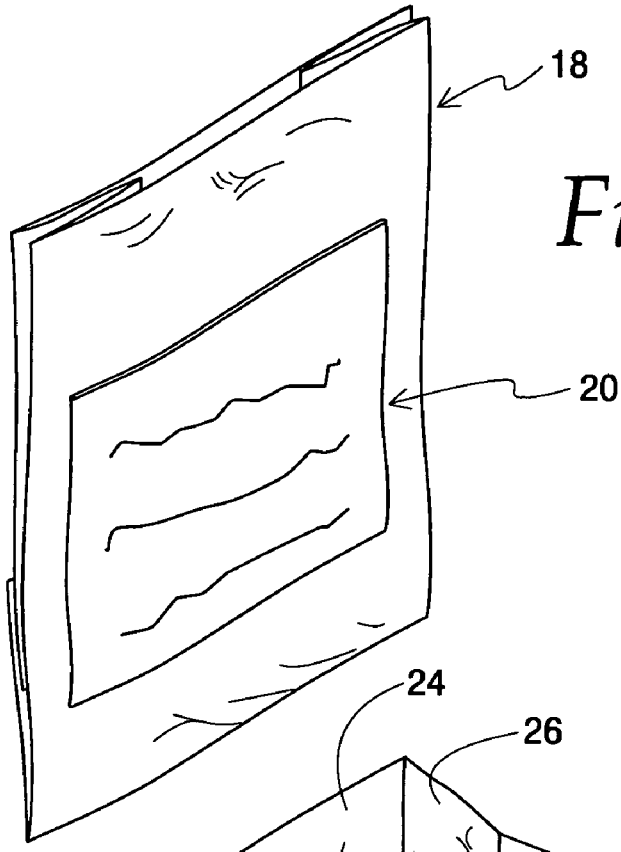
FIG. 1 is a perspective view of a container and a folded bib attached to one face or panel of the sack.

The combination container for preparing foods and folded bib would serve a patron or person with the container loaded with prepared foods and having the foldable bib removably attached to the container. The bib would include means for maintaining the bib in a usable position on a user. The container may be in the form of a paper sack or bag or a paperboard box or the like wherein one panel of the sack or box would have removably attached thereto a folded bib according to the invention. Where the container would be in the form of a sack or bag, it would be appreciated that the sack or bag would be folded for ease of storage and openable for loading of food by a server. The bib would be attached to the sack as shown in FIG. 1. When the bag in open position and loaded with food, the folded bib would continue to be removably attached to one of the panels of the sack and the sack with the food would be delivered to a person or patron for carrying the food to a location for consumption. For example, the sack may be used to carry the food to a table or booth or to an automobile or otherwise to be transported to a home for consumption of the food.

At the time of consumption of the food, the user would remove the bib from the container, unfold the bib to its open position, and then mount the bib onto the person who would be consuming the prepared foods from the sack. The folded bib would give the appearance of a folded napkin but when opened up would include a hanger for hanging the bib from the neck of a person. The hanger could be in the form of a more rigid material than the bib so as to provide the necessary support for the bib during usage or be otherwise formed to support the bib over the clothing of the user. The bib would protect the user's clothing against soiling caused by food falling from the person's hands or otherwise. More particularly, condiments that might leak out of the food or food crumbs and the like would be caught by the bib and prevented from contacting and soiling the user's clothing. It will be appreciated that both the container and the bib would be disposable after usage.

It should also be appreciated that a person ordering food may want to have additional bibs if the amount of food purchased was intended to be eaten by a number of persons. Then the server could provide to the user at the user's request one or more additional bibs, perhaps at a further nominal cost. The additional bibs would be folded and provided with a tab that may easily be manipulated to allow the bib to be opened for usage. With respect to a bib that is detachably mounted on a container, that bib would be held in folded position by the attaching process.

Referring now to the drawings, and particularly to FIG. 1, a folded sack, generally designated by the numeral 18, includes a folded bib mounted thereon, generally designated by the numeral 20. In this form, the sack or bag and bib would be suitable for storage purposes. It will be appreciated that any desired indicia may be provided on the sack and/or the bib for advertising or other purposes.

Figure 2:
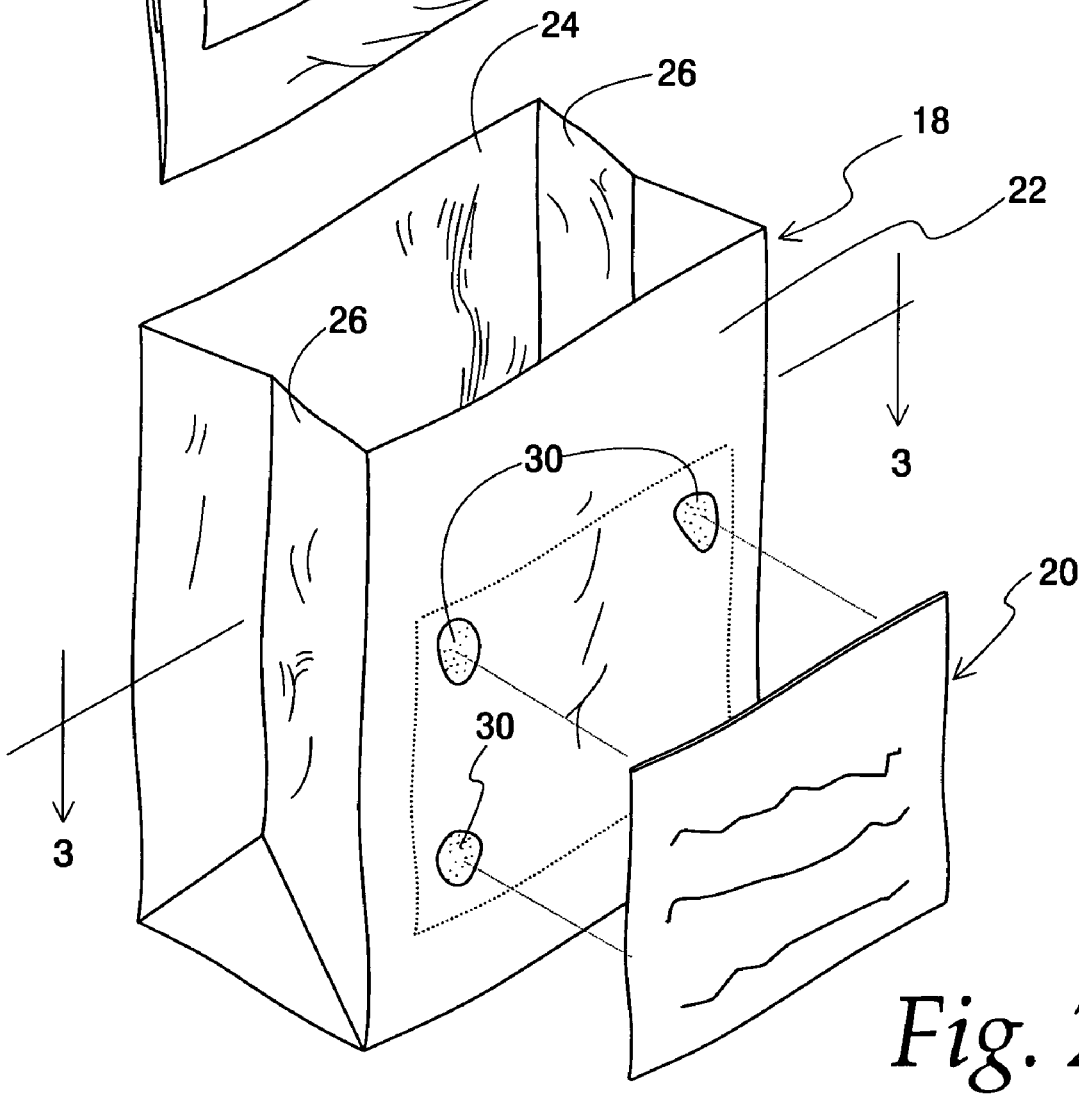
FIG. 2 is a perspective and exploded view of the sack and folded bib shown in FIG. 1 with the sack shown in open position for the loading of food and the bib in exploded position from the sack as it is to be removed for use by a person or patron for use.
Figure 3:
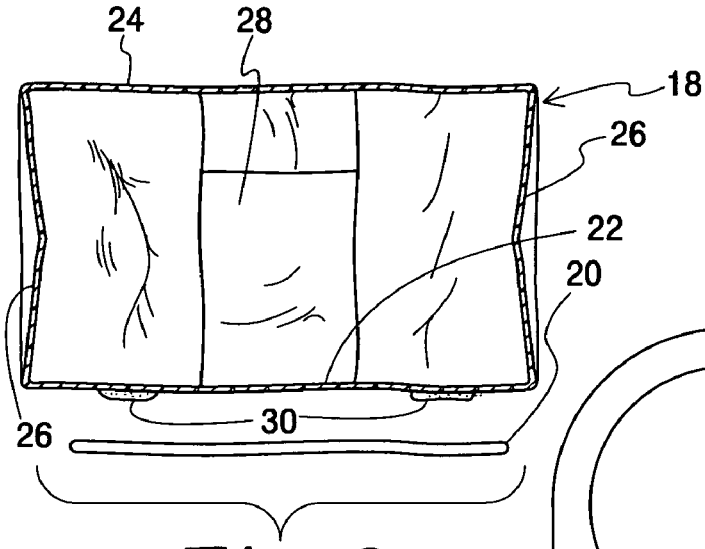
FIG. 3 is a transverse sectional view taken substantially along line 3-3 of FIG. 2.

When the sack is readied for loading of prepared foods, it is opened, as shown in FIG. 2, wherein the sack includes a front panel or side 22, an opposing back panel 24, and foldable side panels 26. It will be appreciated that the sack is of the well known type that have long been commercially available, and usually made of paper, although it may be made of any suitable material. The sack includes a bottom panel 28 as seen in FIG. 3 which closes the sack at one end and leaves it open at the upper end for loading of food. After prepared foods are loaded into the sack, the upper ends may be closed and crimped if desired in a manner well known for the usage of such sacks when handing the packaged food to a customer or patron. Any suitable type of paper may be used for construction of the sack, and it may be of paper or plastic material. Folds are shown in the side panels 26 of the usual type that may be used for collapsing the sack and placing it in storage form, as shown in FIG. 1.

In order to detachably mount the foldable bib 20 to the front panel 22 of the sack, one or more low-tack, repositionable, pressure-sensitive adhesive areas 30 may be provided that will allow ease of separation of the folded bib from the sack without tearing or damage to the sack or bib. It will be appreciated that any suitable number of adhesive areas may be provided and which may be initially provided on the bib as opposed to the sack panel, all for the purpose of detachably mounting the bib to the sack. The thickness of the layer of adhesive shown in FIG. 3 is exaggerated for purposes of illustrating the adhesive having been applied to the front panel of the sack.

Figure 4:
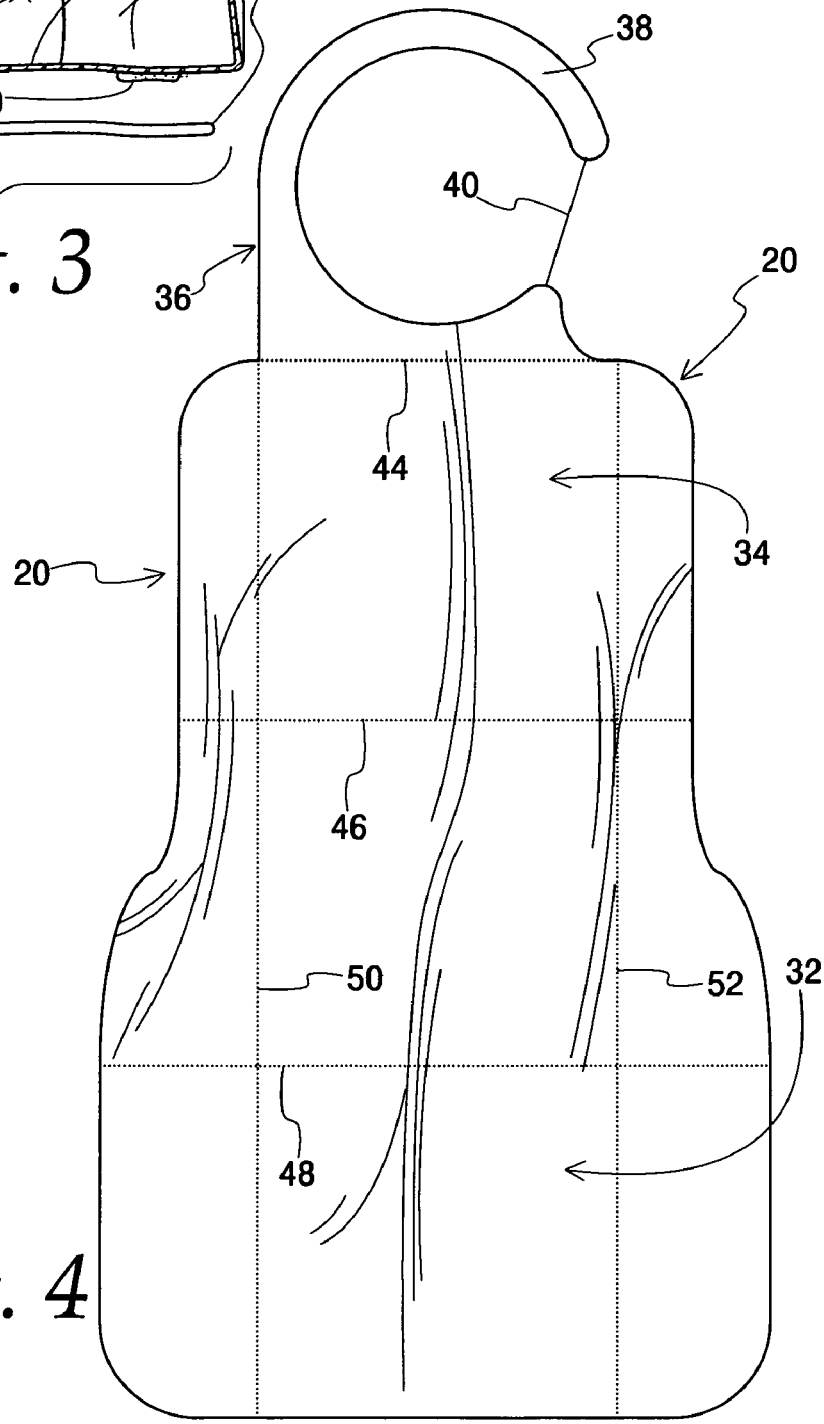
FIG. 4 is a laid open view of the bib in unfolded position and showing the fold lines by dotted lines.

One form of bib according to the present invention is shown in FIG. 4 which includes a lower portion 32, an upper portion 34 integral with the lower portion and necked down to be narrower in width, and a hanger 36. It will be appreciated that the lower and upper portions 32 and 34 may take whatever shape desired but preferably be of a size to assure protection of clothing below the mouth of a person. The lower and upper portions will preferably be made of any suitable absorbent paper such as used with napkins although it will be appreciated that these portions may be made of a suitable plastic material. In any event, the thickness of the paper or the plastic material would be such as to enable the bib to be easily shaped on a person's body to cover the areas desired to be protected. Preferably, the bib would be made of an absorbent paper material similar to that of napkins that are well known and commercially available. However, the lower and upper portions could be made of a suitable light plastic film that would also serve to be foldable and would protect the person's clothing. The corners of the bib may be rounded as shown or otherwise shaped.

Figure 5:
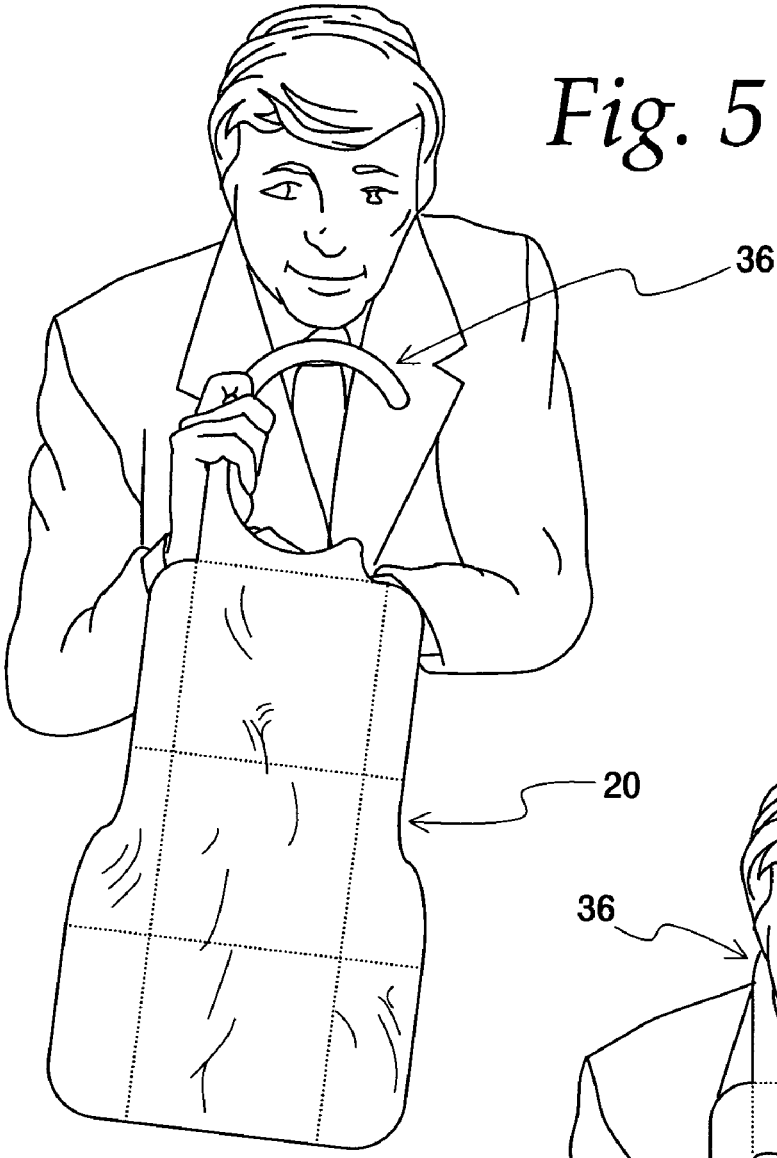
FIG. 5 is a perspective view of a person holding the unfolded bib by one hand in a position to mount the bib on the person's neck for use and further illustrating the fold lines of the bib by dotted lines.
Figure 6:
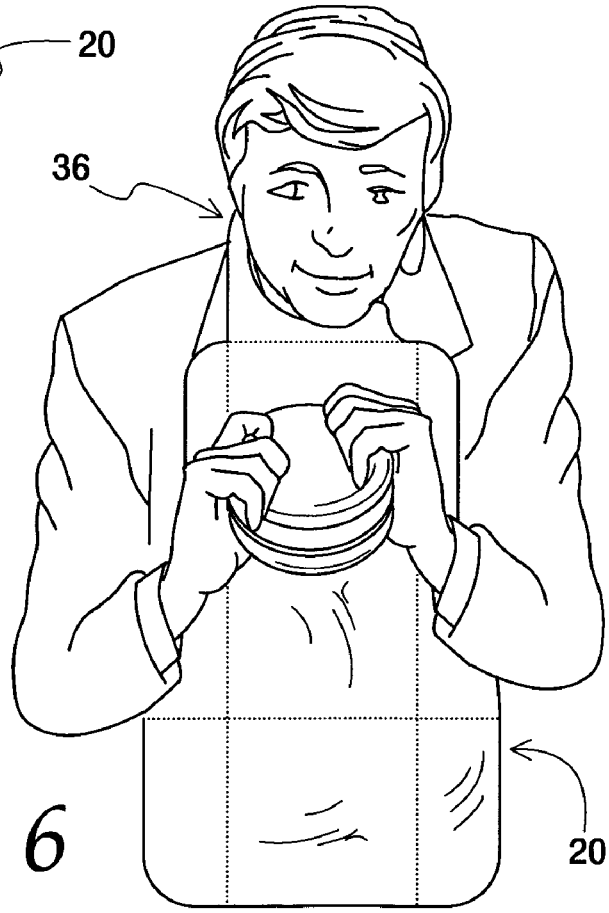
FIG. 6 is a view of the person in FIG. 5 with the bib mounted on the person's neck and the person holding a sandwich to be eaten in a position over the bib to protect the person's clothing during eating of the sandwich.

The hanger may be made of any suitable material, and in any suitable form capable of maintaining the bib in place on a user. The hanger 36 in the embodiment of FIGS. 4 to 6 is made of a stiffer paperboard or plastic material in order to maintain its shape when hung on the neck of a person so that it can properly support the bib in place over a person's clothing. Further, it will be understood the hanger would be suitably connected to the bib, such as by a suitable adhesive.

The hanger 36 in the embodiment of FIGS. 4 to 6 is in the form of a hook 38 defining an open area 40 that would facilitate the mounting of the hanger on the neck of a person. As above mentioned, a suitable stiffer material could be a light-weight cardboard. It would have sufficient rigidity or stiffness to support the weight of the bib and withstand usage of the bib during eating of food. The hook 38 defines an open area 40 through which the neck of a person could be received during the mounting of the bib on the person using the bib. It will be appreciated that the hook 38 would be sufficiently flexible so that it could be flexed to facilitate the mounting of the hook on the neck of a person as well as the dismounting of the bib after completing the eating of the food.

Figure 7A:
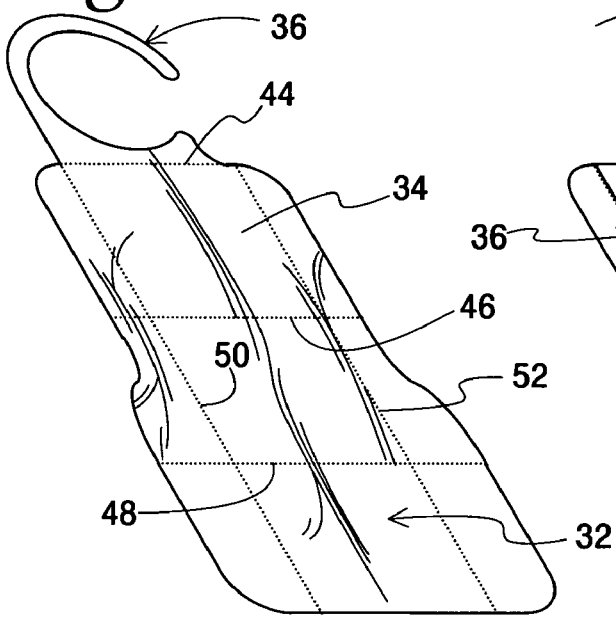
FIGS. 7*a* through 7*e* are perspective views of the bib sequentially illustrating the folding of the bib from its open position as shown in FIG. 7*a* to its completely folded position shown in FIG. 7*e* for subsequent attachment to a food container, or for use otherwise.
Figure 7B:
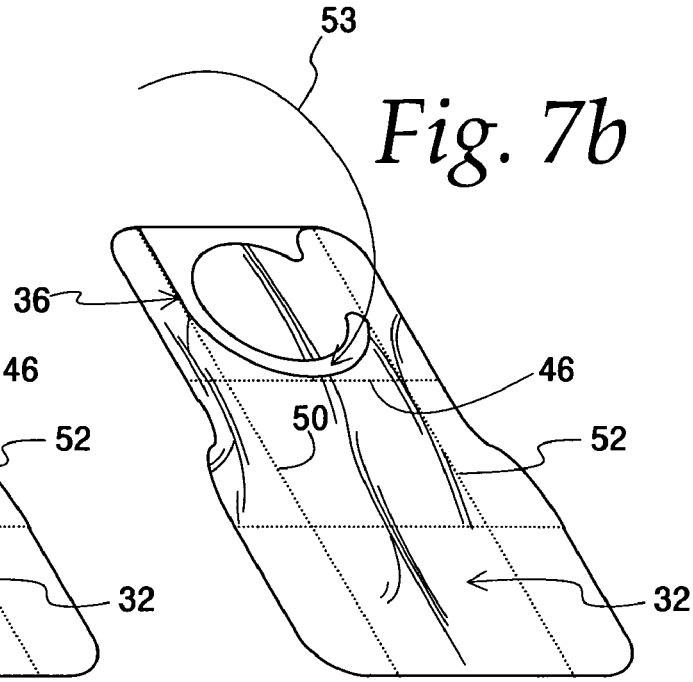
Figure 7C:
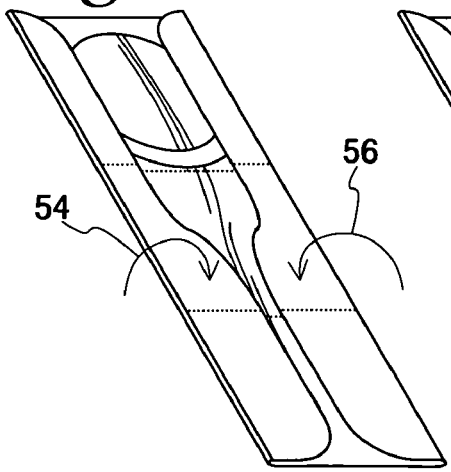
Figure 7D:
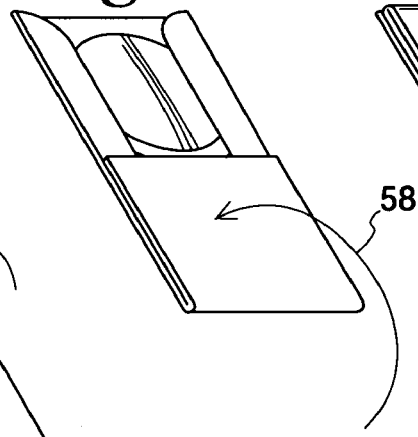
Figure 7E:
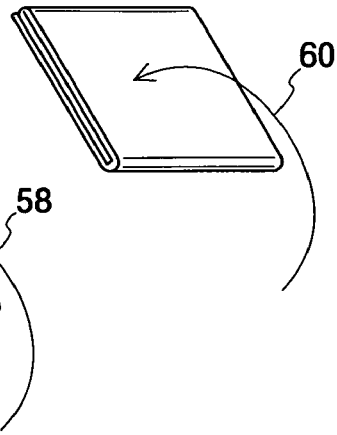

While it should be appreciated that the bib 20 may be folded in any suitable manner in order to provide it in folded form for mounting on the side of a container, fold lines are shown in FIG. 3 which include an upper horizontal fold line 44 between the hanger 36 and the body of the bib, an intermediate horizontal fold line 46 and a lower fold line 48, and spaced apart parallel vertical fold lines 50 and 52. The manner in which the bib is folded is shown in the sequential folding views of FIGS. 7*a*, 7*b*, 7*c*, 7*d* and 7*e*. FIG. 7*a* illustrates the bib in completely unfolded position. FIG. 7*b* illustrates the folding down of the hanger 36 onto the upper part of the upper portion 34 of the bib as indicated by the arrow 53 and along fold line 44. Next, the opposite sides of the bib are folded inwardly as shown by the arrows 54 and 56 in FIG. 7*c* along fold lines 50 and 52, thereby attaining the width of the bib. The next fold is shown in FIG. 7*d* wherein the lower portion of the bib is folded upwardly along fold line 48 in the manner shown by arrow 58. Thereafter, the double folded area at the lower end of the bib is folded upwardly according to the arrow 60 along fold line 46 and against the upper part of the bib to place the bib in completely folded form, as shown in FIG. 7*e*. It is in this form that it is then attachably connected to the front panel of the container by the low-tack repositionable adhesive areas 30 on the sack.

While the bib illustrated in FIG. 7 includes two vertical folds and three horizontal folds to completely fold the bib, as shown in FIG. 7*e*, and these are the preferred folds for this embodiment, it can be appreciated that any suitable number of folds may be used to properly fold a bib to be attached to a food container. An example of a bib with different folds is illustrated in FIGS. 10*a* to 10*h*.

Figure 8:
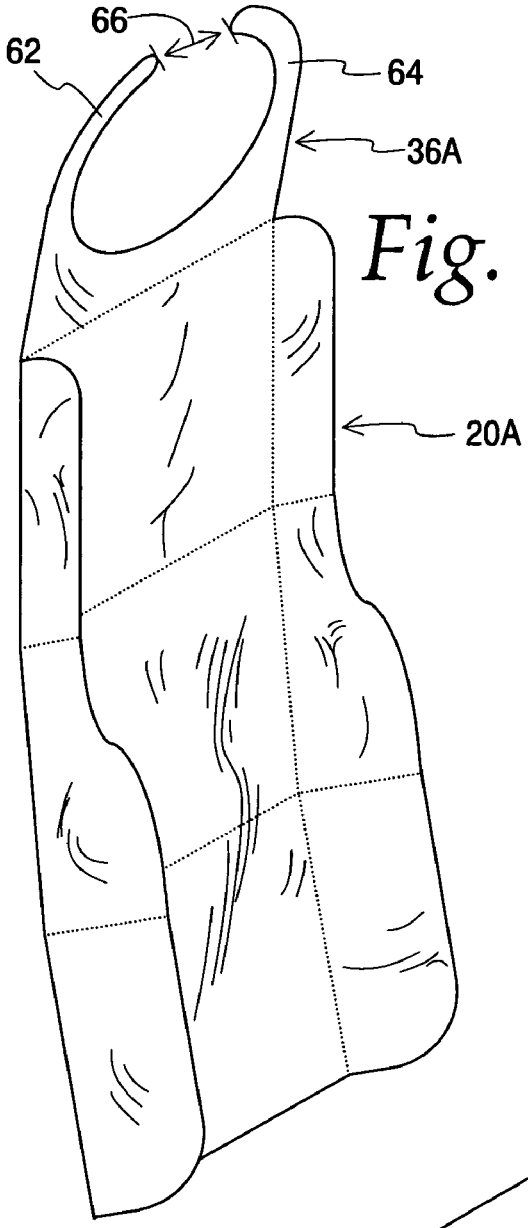
FIG. 8 is a perspective view of a partially unfolded bib having a modified hanger in the form of a horseshoe.

Referring now to FIG. 8, a modified bib 20A is shown which differs from the bib 20 only in the configuration of the hanger 36A. The hanger 36A is in the form of a horseshoe which includes opposed flexible arms 62 and 64 that are substantially identical in shape and which define an opening 66 to facilitate the mounting of the hanger onto a person's neck. Although the opening is not wide enough to initially allow mounting on the neck of a person, it will be appreciated that by manipulating the arms 62 and 64, each of which would be normally grasped by the hands of the user, the opening would increase in size to allow the arms 62 and 64 to go around the neck of a person. Like the hanger 36, the hanger 36A is also of a more rigid material than the bib portions in order to facilitate support of the bib on a person's neck but flexible enough to be flexed when mounting the hanger on a user's neck and thereafter removing the bib for disposal. While the hangers illustrated in the drawings are in the form of material more rigid than the bib material, any suitable hanger that could be easily folded with the bib may be used. For example, a very thin spring wire material may be used in the form of a hook or horseshoe. Also, a stranded material such as a flexible filament or string permanently connected at one end to one side of the bib and detachably connectable at the other end to the other side of the bib could be used to support the bib on a user.

Figure 9:
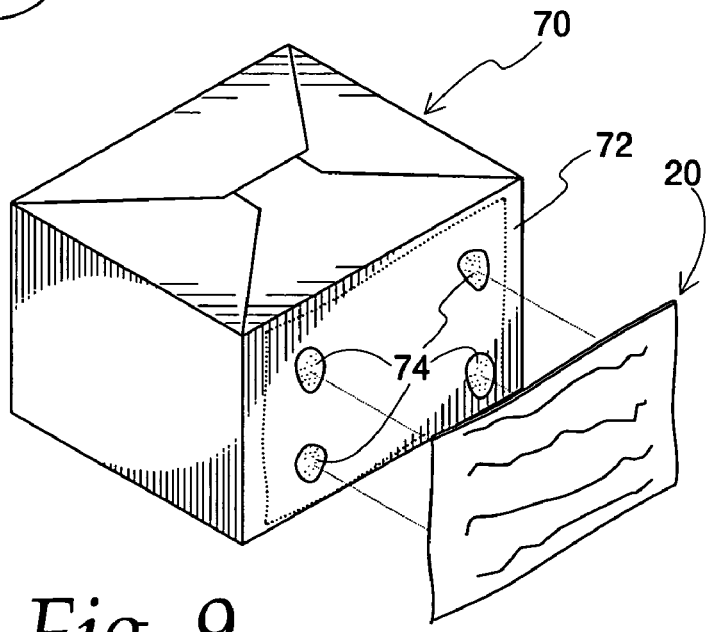
FIG. 9 is a perspective view of a box container and showing in exploded view a folded bib according to the invention and how it would be removably attached to one side or panel of the box.

Referring now to FIG. 9, a box-shaped food container 70 is shown to which the bib 20 would be detachably connected in a manner similar to the way the bib 20 in FIGS. 1 to 3 is connectable to the paper sack 18. The box container 70 would first be in a flat folded form in the usual manner so that it would facilitate storage of the container and it would then have the bib 20 secured on one of the panels. The food server would erect the box and open the top panels defining the cover so that food could be loaded into the box container. Thereafter, the server would close the panels in order to deliver the food container with the bib to a customer.

The box 70 includes a front panel 72 to which the bib 20 would be detachably connected by one or more applications of a low-tack, repositionable, pressure-sensitive adhesive 74. If desired, another bib could be detachably mounted on a rear or side panel. As illustrated, four applications or areas of low-tack, repositionable, pressure-sensitive adhesive are shown which would detachably connect the bib at the four corners to the box, but it should be appreciated that any number of adhesive applications may be used to provide the detachable mounting of the bib to the box. This box-type container would be made of a suitable paperboard having a rigidity sufficient to allow the container to maintain its shape.

It will also be appreciated that other shapes of containers may be used and which would have a panel onto which a bib may be detachably mounted. For example, although not shown, an O-shaped container or a round container may be employed.

Figure 10A:
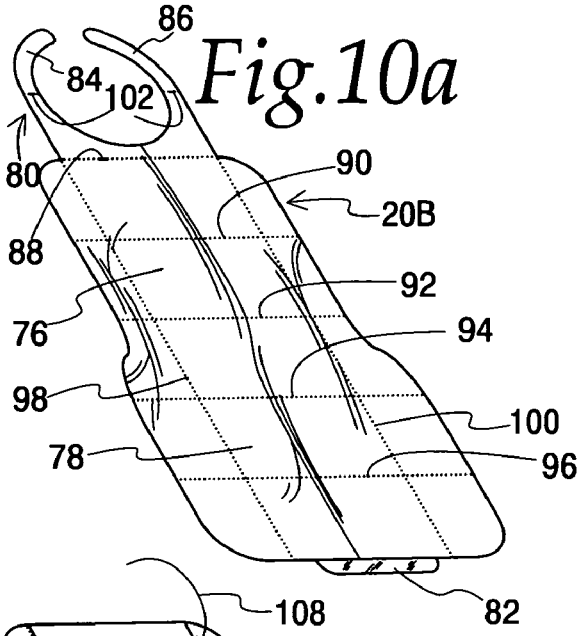
FIGS. 10*a* through 10*h* are perspective views of a further modified folded bib that may be provided separately from a container, and sequentially illustrating the bib from completely unfolded form in FIG. 10*a* to its completely folded form shown in FIG. 10*h*.
Figure 10B:
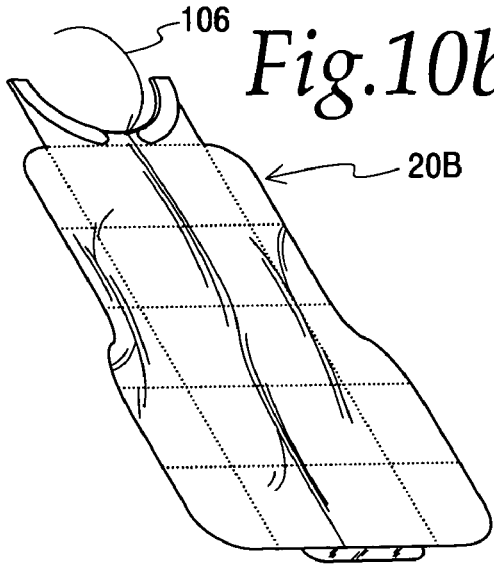
Figure 10C:
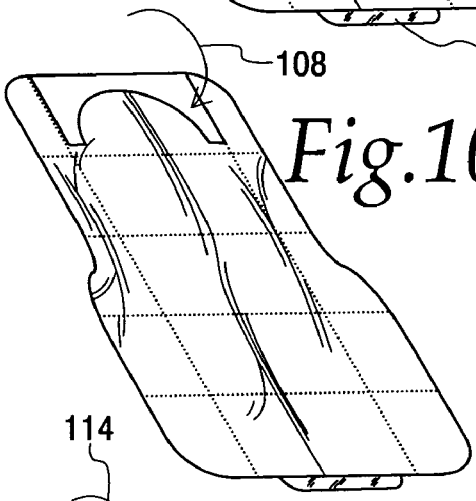
Figure 10D:
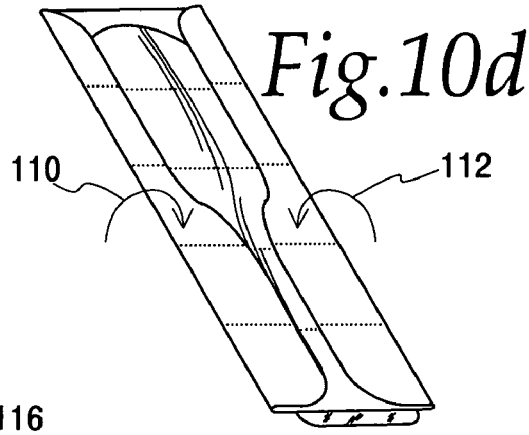
Figure 10E:
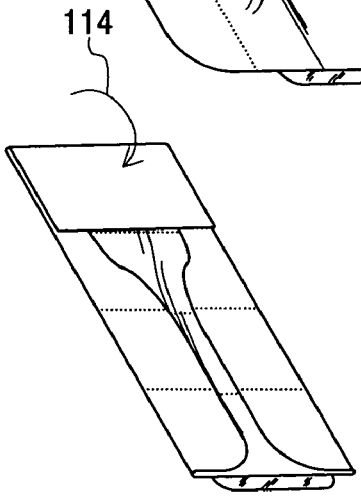
Figure 10F:
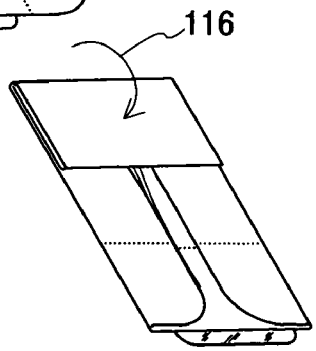
Figure 10G:
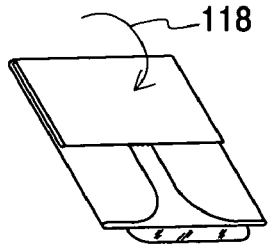
Figure 10H:
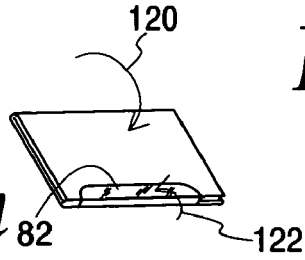

Another embodiment of the invention is disclosed in FIGS. 10*a* to 10*h* in the form of a bib that can be separately dispensed where it would be desirable to have a plurality of bibs with anyone serving food or where it might be desired to be able to provide the bibs for sale in a store. The bib embodiment of FIGS. 10*a* to 10*h* is similar to that of the earlier embodiments that is preferably a paper-type bib that is foldable and provided with a hanger at the upper end for easily mounting the bib onto a person's neck. The bib would then hang down from the neck and cover the person's clothing below the mouth of the person and protect the clothing during eating of the food. Initially, this bib would be in completely folded form, as shown in FIG. 10*h* where on request it could be handed to a person for his own use thereafter. The bib would then be opened and then put into use by hanging the bib from a person's neck and which would allow the bib to overlie the clothing of the user.

This bib, generally designated by the numeral 20B, like the previous bib, includes an upper portion 76, a lower somewhat wider portion 78, and a hanger 80. Additionally, it would include a tab 82 to maintain the bib in closed position, as will be more clearly explained below.

The hanger 80 includes opposed generally semi-circularly shaped arms 84 and 86 to define a horseshoe-shaped hanger like the hanger in the embodiment of FIG. 8. It will also be similarly operable as the embodiment in FIG. 8 in that the arms can be manipulated to allow the opening in the upper end of the arms to enlarge so that it can be placed around the neck of a person.

The bib 20B includes an upper horizontal fold line 88, intermediate horizontal fold lines 90, 92 and 94 and a lower fold line 96. The upper horizontal fold line 88 serves to allow the folding of the hanger onto the bib, as will be further explained. The pair of opposed vertical fold lines 98 and 100 are provided for allowing the bib to be folded along the vertical axis, as will be explained. Finally, a pair of fold lines 102 is provided on the arms 84 and 86 of the hanger 80 to facilitate the folding of the arms during the overall folding of the bib and making it a compact package.

When folding the bib into the form shown in FIG. 10*h*, the hanger arms 84 and 86 are folded along the fold lines 102 and as shown by the arrow 106 in FIG. 10*b*. Thereafter, the folded hanger is folded onto the bib as shown by the arrow 108 in FIG. 10*c*. Next, the sides of the apron are folded along the vertical lines 98 and 100 as shown in FIG. 10*d* and as indicated by the arrows 110 and 112. Thereafter, the bib is folded down toward the bottom of the bib in sections as shown in FIGS. 10*e* and 10*h* where it is first folded along the fold line 90 as indicated by the arrow 114 in FIG. 10*e*, then along the fold line 92 as shown by the arrow 116 in FIG. 10*f*, followed by the folding along the fold line 94 as indicated by the arrow 118 in FIG. 10*g*. Finally, the last fold is made, along the fold line 96 as indicated by the arrow 120 in FIG. 10*h*.

Thereafter, the tab 82 is folded up over the last fold as indicated by the arrow 122 to completely close the bib. The side of the tab that folds over the last panel of the bib and engages the panel is provided with a low-tack, repositionable, pressure-sensitive adhesive in order to maintain it in closed position. However, that tab can easily be pulled away from the bib to allow the bib to be opened for use in the reverse order of the way the bib has been closed and folded. The tab 82 is suitably connected by an adhesive to the one panel of the bib as indicated in FIG. 10*a*, and thereafter will detachably connect to the last fold of the bib as shown in FIG. 10*h*. While the tab may be of any suitable material, it could be of a glassine or cellophane material that has some rigidity to facilitate handling and which may be transparent.

Figure 11:
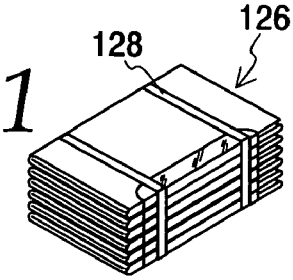
FIG. 11 is a perspective view of a stack of bibs like the bib of FIGS. 10*a* to 10*h*.

This folded bib may be provided individually and sold individually to a user as the user so requests, or it may be provided in packets of a plurality of bibs, such as a packet generally indicated by the numeral 126 in FIG. 11 where six bibs are stacked in stacked relationship and held together by one or more paper, plastic or rubber bands 128. Any number of bibs may be provided in a packet, and these packets may be sold at a restaurant or from any consumer store, such as a drugstore, grocery store, convenience store, or the like, for use by those wanting to use this type of a bib. It will be appreciated that any number of folds may be provided in a bib, and that additional folds like that shown in FIGS. 10*a* to 10*h* indicate the ability for the bib to be folded into a smaller and more compact form for dispensing to customers. The thickness of any bib would depend upon the thickness of the material to make the bib.

It will be understood that modifications and variations may be effected without departing from the scope of the novel concepts of the present invention, but it is understood that this application is to be limited only by the scope of the appended claims.

The invention claimed is:

1. A food container and a bib, wherein the food container is adapted to be used for holding prepared foods to be sold to and eaten by a patron/person and the bib is adapted to be used by the patron to protect against food spillage on the patron's clothing during removal of the foods from the container and the consumption thereof, said container having at least one panel, said bib being removably attached to said one panel of the container and completely separable from the panel and the container, said bib being folded with a multiple of folds, means on one of the container panels and/or the bib for removably attaching the bib to the container, and said bib when removed from the container and unfolded including means for hanging the bib from the neck of the patron.

2. The food container and bib of claim 1, wherein the food container is a sack adapted to be folded into a collapsed condition for storage, or be in an open position for the loading and removal of food.

3. The food container and bib of claim 1, wherein the food container is a box adapted to be folded into a collapsed condition for storage, or be in an open position for the loading and removal of food.

4. The food container and bib of claim 1, wherein said means for hanging the bib from the neck of a person includes a hook-shaped member.

5. The food container and bib of claim 1, wherein said means for hanging the bib from the neck of a person includes a horseshoe-shaped member.

6. The food container and bib of claim 1, wherein said container and bib are made of paper material.

7. The food container and bib of claim 1, wherein said means on one of said container panels and/or the bib for detachably connecting the bib to the container includes a low-tack, pressure-sensitive adhesive.

8. A food container and a bib, wherein the food container is adapted to be used for holding prepared foods to be sold to and eaten by a patron and the bib is adapted to be used by the patron to protect against food spillage on the patron's clothing during removal of the foods from the container and the consumption thereof, said container being foldable into a substantially flat form for storage, and openable to an open position for the loading of prepared food therein, said container having front, rear, side and bottom panels, said bib being folded with multiple folds and completely separable from the container, and means on one of the front or rear panels of the container and/or the folded bib for removably attaching the bib to the container, and said bib when removed from the container and unfolded including means for hanging the bib from the neck of the person.

9. The food container and bib of claim 8, wherein the food container is a sack adapted to be folded into a collapsed condition for storage, or be in an open position for the loading and removal of food.

10. The food container and bib of claim 8, wherein the food container is a box adapted to be folded into a collapsed condition for storage, or be in an open position for the loading and removal of food.

11. The food container and bib of claim 9, wherein said means for hanging the bib from the neck of a person includes a hook-shaped member.

12. The food container and bib of claim 9, wherein said means for hanging the bib from the neck of a person includes a horseshoe-shaped member.

13. The food container and bib of claim 11, wherein the sack and bib are made of paper material.

14. The food container and bib of claim 10, wherein the box is made of paper board and the bib is made of paper.

15. The food container and bib of claim 13, wherein said means on one of said container panels and/or the bib for detachably connecting the bib to the container includes a low-tack, pressure-sensitive adhesive.

16. The food container and bib of claim 14, wherein said means on one of said container panels and/or the bib includes a low-tack, pressure-sensitive adhesive.

17. The combination of a food container and a bib, wherein the food container is adapted to receive prepared foods to be delivered to a user and the bib is adapted to be used by the user to prevent soiling of clothing during consumption of the foods in the container, said container being in folded form and openable for loading and unloading foods, and including a plurality of panels with a bottom and an openable top into which food may be loaded, said bib including multiple folds and being detachably connected to a panel of the container and completely separable from said container for use and including a hanger for supporting the bib on the user, and said bib and hanger when unfolded adapted to be hung from the neck of the user and covering the clothing of the user, whereby the food container and bib provides a vehicle for delivering prepared foods to a user along with means for facilitating the consumption of the foods to protect the clothing of the user.

* * * * *